US009713366B2

(12) United States Patent
Olson et al.

(10) Patent No.: US 9,713,366 B2
(45) Date of Patent: Jul. 25, 2017

(54) BI-STABLE SUPPORT FIXTURE FOR ADDITION OF PENDANTS TO JEWELRY CHAINS

(71) Applicant: DPG USA Inc., Schaumburg, IL (US)

(72) Inventors: John C. Olson, Livingston, TX (US); Ronald C. Farnum, Lombard, IL (US); Nikhil Gupta, Schaumburg, IL (US)

(73) Assignee: DPG USA INC., Schaumburg, IL (US)

( * ) Notice: Subject to any disclaimer, the term of this patent is extended or adjusted under 35 U.S.C. 154(b) by 177 days.

(21) Appl. No.: 14/730,555

(22) Filed: Jun. 4, 2015

(65) Prior Publication Data

US 2015/0351504 A1 Dec. 10, 2015

Related U.S. Application Data

(60) Provisional application No. 62/008,070, filed on Jun. 5, 2014.

(51) Int. Cl.

| | |
|---|---|
| ***B23Q 3/00*** | (2006.01) |
| ***A44C 27/00*** | (2006.01) |
| *A44C 11/00* | (2006.01) |
| *A44C 25/00* | (2006.01) |

(52) U.S. Cl.

CPC ..... *A44C 27/00* (2013.01); *A44C 11/00* (2013.01); *A44C 25/001* (2013.01)

(58) Field of Classification Search

USPC ..... 269/9

See application file for complete search history.

(56) References Cited

U.S. PATENT DOCUMENTS

| | | | | | |
|---|---|---|---|---|---|
| 494,780 | A * | 4/1893 | Heim | A44C 11/00 | 59/13 |
| 518,441 | A * | 4/1894 | Barnes et al. | A44C 11/00 | 59/13 |
| 524,794 | A * | 8/1894 | Smith | A44C 11/00 | 59/13 |
| 668,377 | A * | 2/1901 | Koch | B25B 1/04 | 269/157 |
| 941,831 | A * | 11/1909 | Widmann | G04D 3/045 | 279/106 |
| 3,055,329 | A * | 9/1962 | Door | B21D 53/44 | 269/161 |

(Continued)

*Primary Examiner* — Alvin Grant

(74) *Attorney, Agent, or Firm* — Robert S. Alexander; Ferrells, PLLC; Anna L. Kinney

(57) ABSTRACT

A support fixture is provided for holding chain to facilitate addition of pendants thereto. The fixture comprises a polymeric base and a pair of inter-nesting uprights pivotably mounted therein at opposed ends of the base. The uprights can be stably disposed in either an upright usage configuration or a nested horizontal configuration. The base has an upper surface with a generally planar periphery and a major centrally located recess formed therein. The upper extremity of each upright is provided with a retention pin and a padded clamp. Each clamp is formed from a "7" shaped portion and an inverted "L"-shaped arm pivotably joined thereto, with horizontal portions of the "L" shaped arm and the "7" shaped portion defining the jaws of the clamp. A resilient spring is disposed between a vertical leg of the "7" shaped portion and a vertical leg of the inverted "L" shaped arm.

16 Claims, 12 Drawing Sheets

(56) References Cited

U.S. PATENT DOCUMENTS

| | | | | | |
|---|---|---|---|---|---|
| 3,758,101 | A * | 9/1973 | Sewell | B25B 5/06 | 269/254 R |
| 4,171,800 | A * | 10/1979 | Weaver | B25B 5/04 | 269/234 |
| 4,744,552 | A * | 5/1988 | Glaser | A44C 27/00 | 269/71 |
| 5,954,321 | A * | 9/1999 | Spero | B25B 1/22 | 269/254 CS |
| 7,367,449 | B2 * | 5/2008 | Kaminski | A45C 11/16 | 206/1.5 |
| 7,677,141 | B1 * | 3/2010 | Crew | B25B 5/06 | 81/302 |
| 7,946,424 | B2 * | 5/2011 | Gupta | B65D 81/1075 | 206/472 |
| 2005/0178693 | A1 * | 8/2005 | Gupta | D04D 1/04 | 206/574 |
| 2006/0213048 | A1 * | 9/2006 | Kalanovic | A44C 27/00 | 29/468 |
| 2008/0169219 | A1 * | 7/2008 | Gupta | B65D 85/58 | 206/564 |

* cited by examiner 68
84
76
44
42
78
88
82
81
94

BI-STABLE SUPPORT FIXTURE FOR ADDITION OF PENDANTS TO JEWELRY CHAINS

CLAIM FOR PRIORITY

This Non-Provisional patent application is based on U.S. Provisional Patent Application Ser. No. 62/008,070, filed on Jun. 5, 2014, the priority of which is claimed, and the disclosure of which is incorporated by reference.

BACKGROUND OF THE INVENTION

Charm Bracelets are particularly popular with hobbyists who are engaged in beading as they provide the opportunity to attach a plurality of "charms" or other trinkets having emotional or psychological significance to the beader or those that they give these bracelets to. For example, a grandmother might wish to have a charm representative of each of her grandchildren attached to her charm bracelet. Accordingly, it can be appreciated that as time progresses, it will become necessary to add additional charms to the bracelet. Typically, charms are attached using a jump ring which is a split metallic ring, which serves to link each charm to the bracelet. Jump rings are typically formed from a slightly malleable metal so that the ring will permanently attach the charm to the bracelet. Therefore, it is usually necessary to use considerable force to deform the jump ring sufficiently that a charm can be placed on it and appended to the bracelet. Commonly, this will be done using two pairs of pliers to make it possible to open and then close the jump ring to append the charm to the bracelet. Accordingly, attaching a jump ring and charm to bracelet or other chain can be somewhat problematic.

SUMMARY OF THE INVENTION

The present invention is addressed to a support fixture that holds the chain suspended between two upright arms, making it far easier for the user to attach pendants thereto and appreciate how these are spaced out over the length of the chain in the process. To facilitate storage and transportation of the support fixture, two retractable inter-nesting arms are pivotably attached to a prismatic base having recesses formed therein for storage of charms, pendants, trinkets, and the like that might be attached to a typical bracelet. The retractable inter-nesting arms are configured such that, in the closed position, the arms seal the recesses in the prismatic base so that the support fixture can be carried about easily and work resumed at any odd spare moment that the beader may have available. As many different types of chains are used for jewelry, the upper extremities of each arm bears a pin adapted to penetrate a link of the chain as well as a pivotable padded clamp which can be easily opened with one hand, then relaxed to grip chains with links which do not have a configuration suitable for penetration by the pin. Thus it can be appreciated that the portable support fixture of the present invention makes it quite easy for beaders to attach pendants to chains without requiring assistance from a second person or somehow manipulating the chain and two pairs of pliers simultaneously. The support fixture of the present invention provides a significant advantage in terms of portability as when its uprights are folded inwardly, they are not only retained positively in position making the support fixture flat, compact and easy to be carried around, but also the uprights nest within the base to form a planar surface which is free of projections or snags while sealing interior compartments for storage of small items within. Such easy portability and storability is quite important to beaders who like to carry their work with them to occupy spare moments.

Other aspects and advantages of the present invention are described in the detailed description below and in the claims.

BRIEF DESCRIPTION OF THE DRAWINGS

The invention is described in detail below with reference to the various Figures, wherein like numerals designate similar parts. In the Figures.

DETAILED DESCRIPTION OF A PREFERRED EMBODIMENT

The invention is described in detail below with reference to several embodiments. Such discussion is for purposes of illustration only. Modifications to examples within the spirit and scope of the present invention, set forth in the appended claims, will be readily apparent to one of skill in the art. Terminology used throughout the specification and claims herein is given its ordinary meaning.

Figure 17:
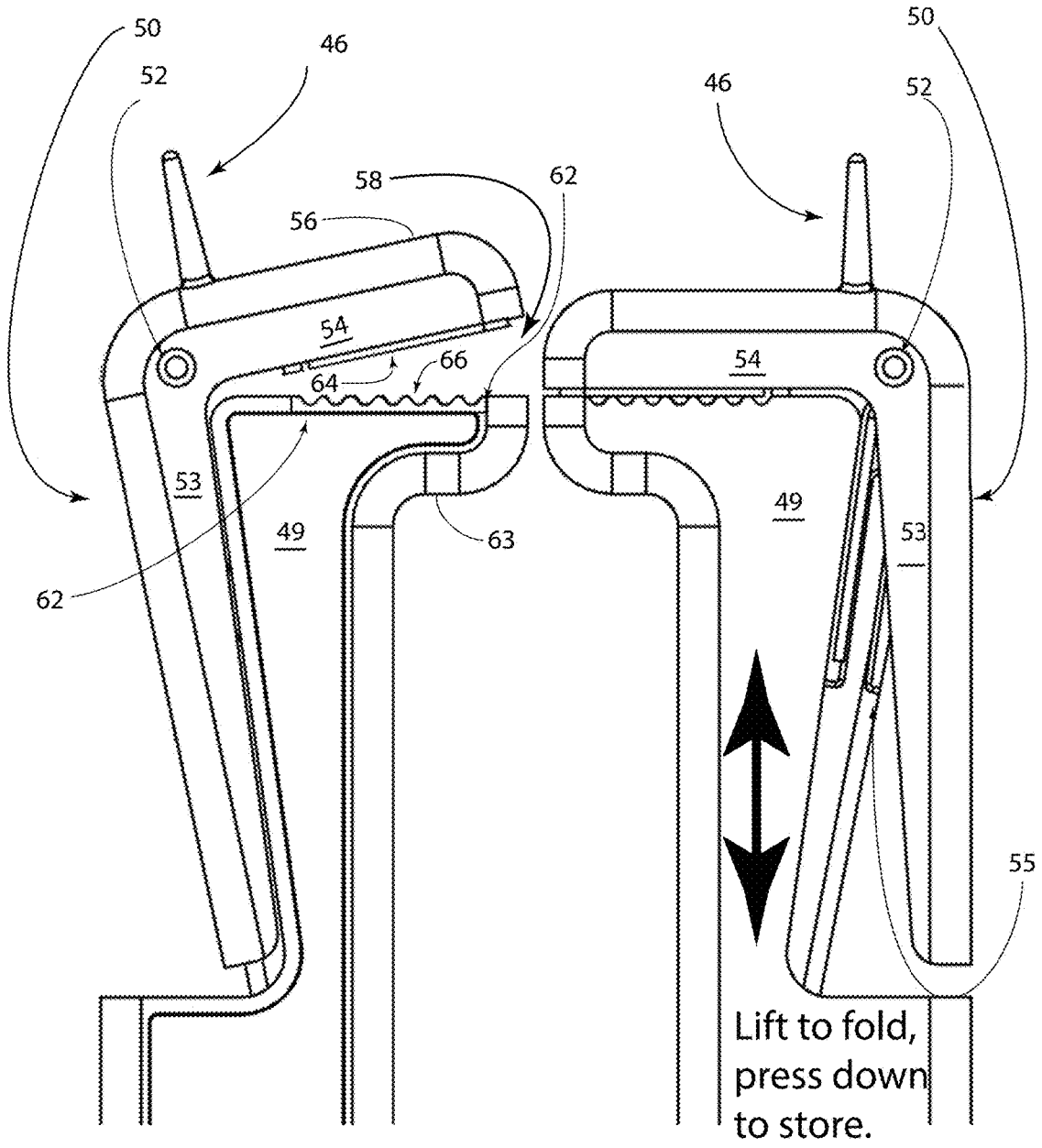
FIG. 17 illustrates an open clamp juxtaposed with a closed clamp.

In FIGS. 1-7, support fixture 30 for chains comprises base 32 having major recess 34 formed therein defining plane 33 about its periphery with secondary recesses 36 and 38 formed centrally therebelow separated by divider 40. At each end of major recess 34 in base 32, inwardly pivotable inter-nesting uprights 42 and 44 are attached such that when uprights 42 and 44 are pivoted inwardly, substantially the entirety of major recess 34 in base 32 is occupied thereby covering over secondary recesses 36 and 38. At the upper extremity of each upright 42 and 44, pin 46 is provided to allow links in chain 48 to be placed thereover if the configuration of chain 48 permits. The upper extremity 49 of each upright 42 and 44 is configured in a conformation of the numeral "7". As best shown in FIG. 17, additionally, "L" shaped arms 50 pivotable about pin 52 are provided thereabove with each of "L" shaped arms 50 being urged outwardly by springs 55, one being positioned between each vertical leg 53 of each of "L" shaped arms 50 and each of vertical legs of "7" shaped upper extremities 49 of each upright 42 and 44. Horizontal leg 54 of each of "L" shaped arms 50 defines upper jaw 56 of mouth 58 of clamp 60 with upper horizontal surface 62 of "7" shaped upper extremity of uprights 42 and 44, serving as lower jaw 63 thereof. Preferably lower surface 54 of each of "L" shaped arms 50 and upper surface 62 of "7" shaped upper extremity of uprights 42 and 44 are provided with layers 64 and 66 of resilient padding to prevent clamps 60 from marring chain 48 when retained thereby.

Figure 1:
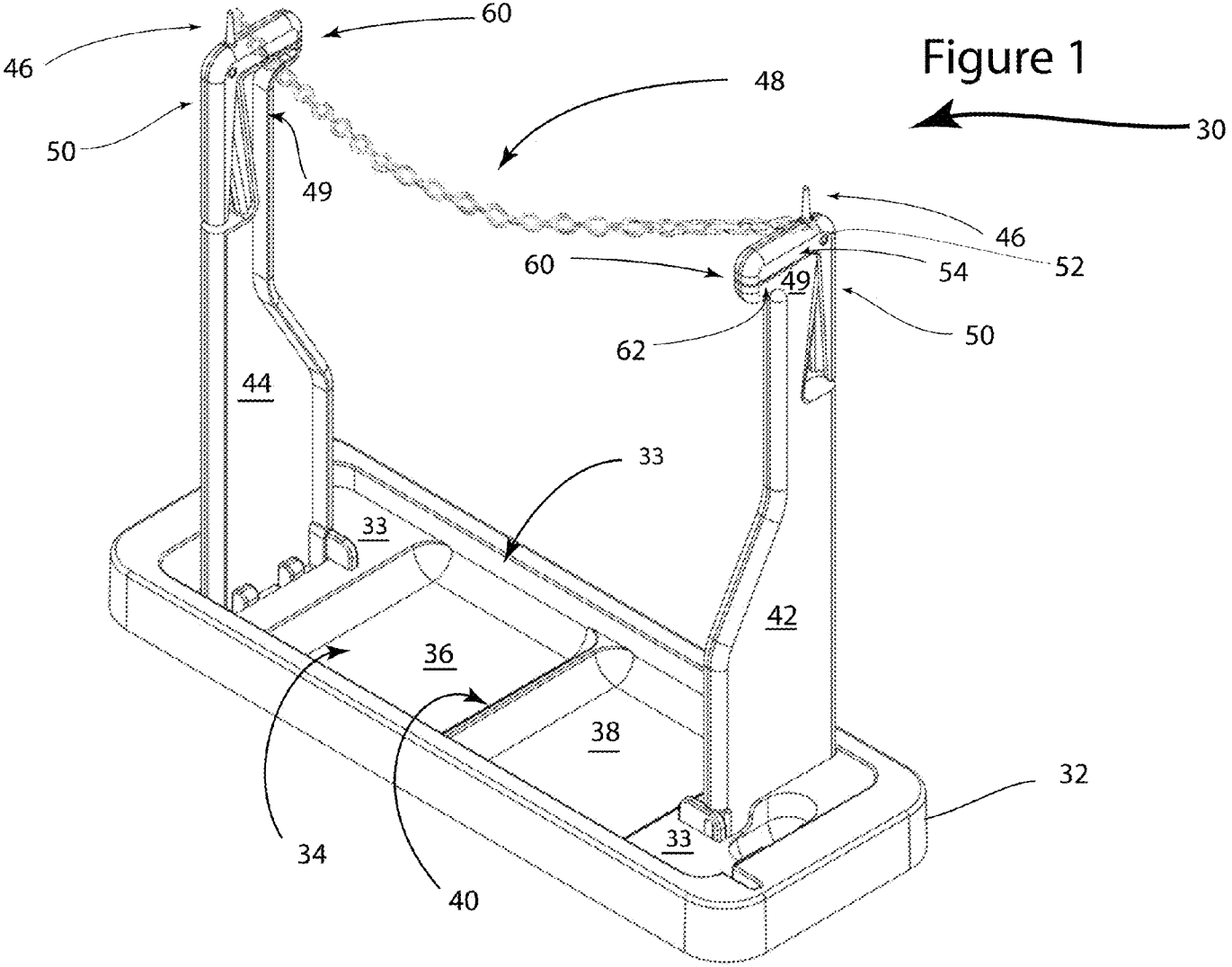
FIG. 1 is a front schematic isometric perspective of a support fixture of the present invention with both arms erected and a chain placed between the arms to facilitate addition of charms using jump rings.
Figure 2:
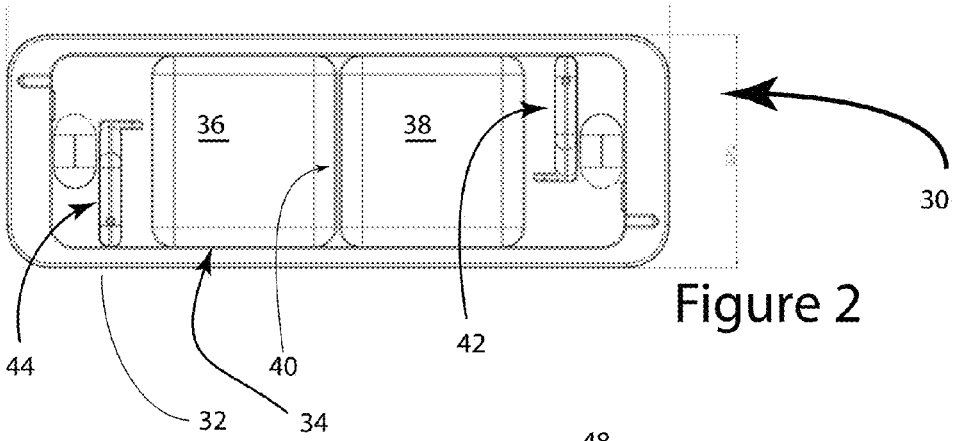
FIG. 2 is a top view of a support fixture of the present invention with both arms erected.
Figure 3:
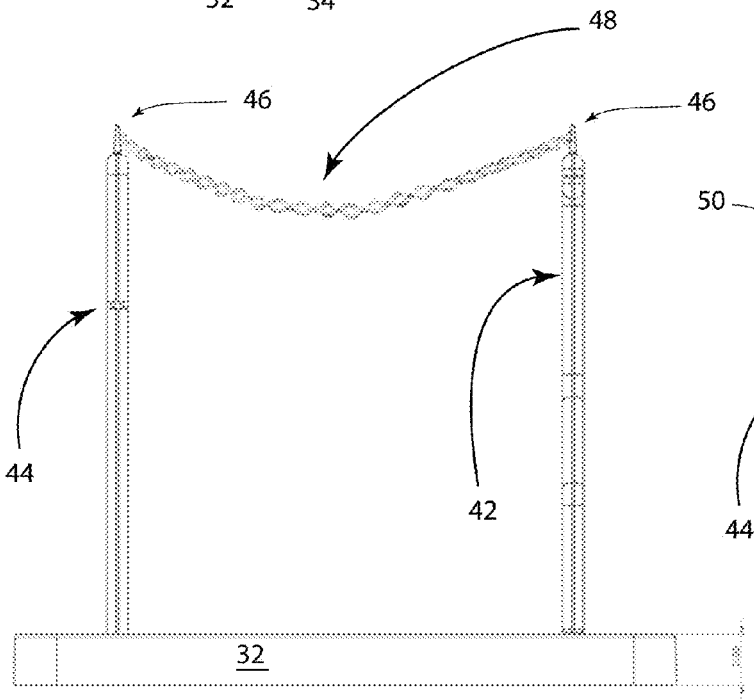
FIG. 3 is a front elevation of a support fixture of the present invention with both arms erected illustrating a chain having each end fastened to one of said erected arms.
Figure 4:
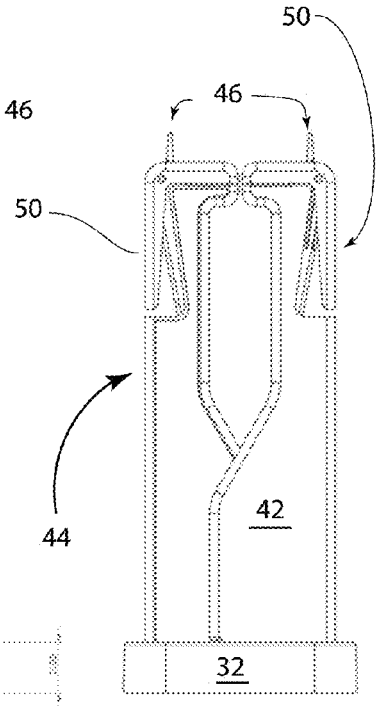
FIG. 4 is a right side elevation of the support fixture of FIG. 3.
Figure 5:
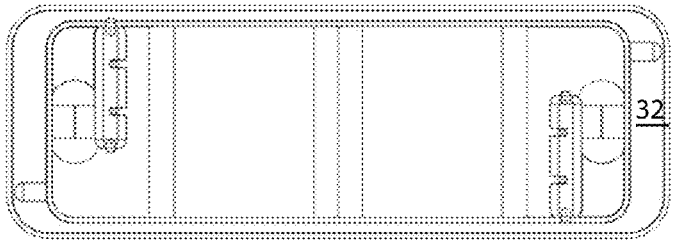
FIG. 5 is a bottom view of the support fixture of FIG. 3.
Figure 7:
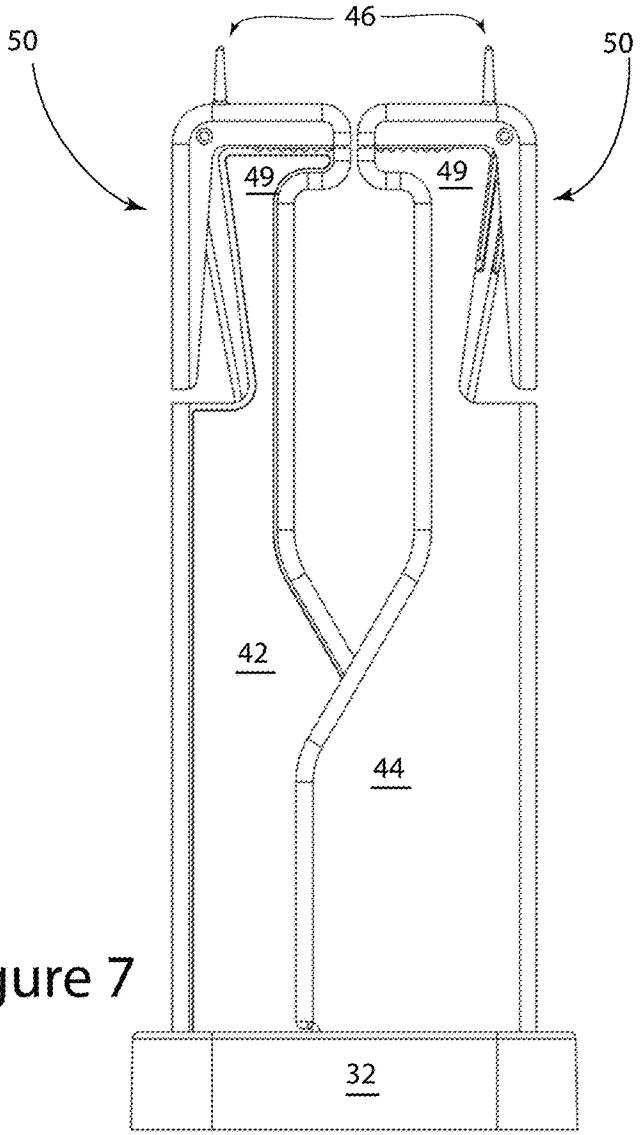
FIG. 7 is a left side elevation of the support fixture of FIG. 3.
Figure 6:
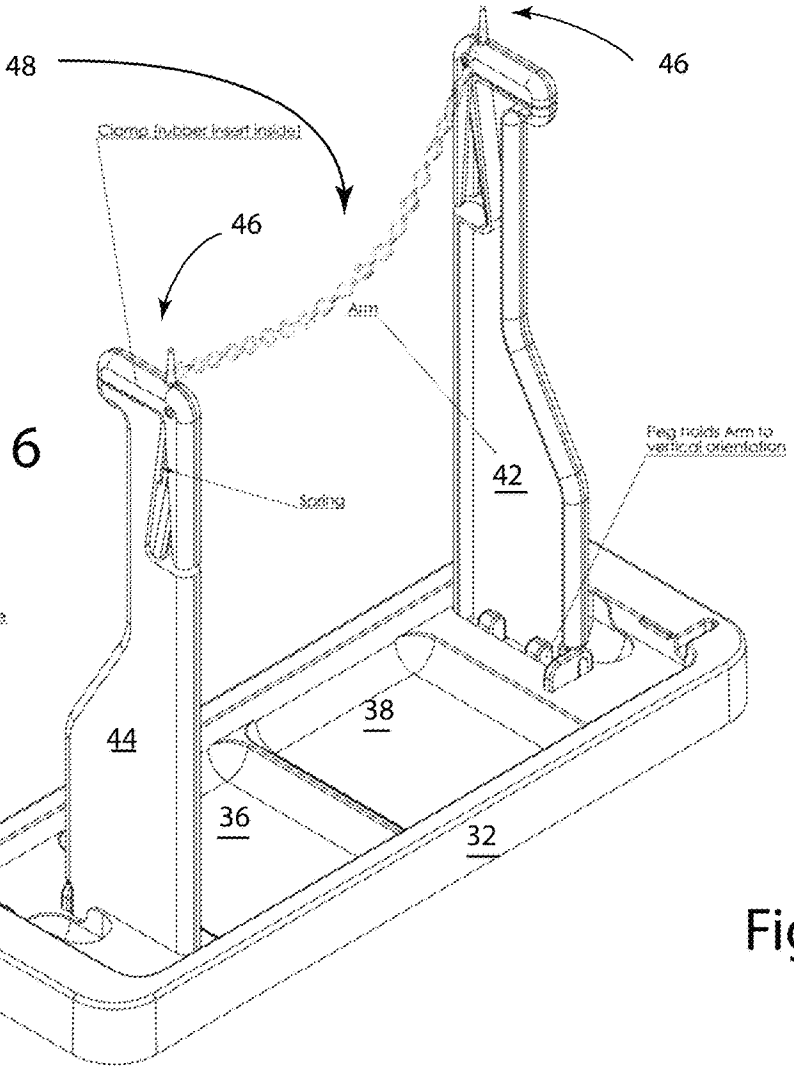
FIG. 6 is a rear schematic isometric perspective of the support fixture of right FIG. 3.
Figure 8:
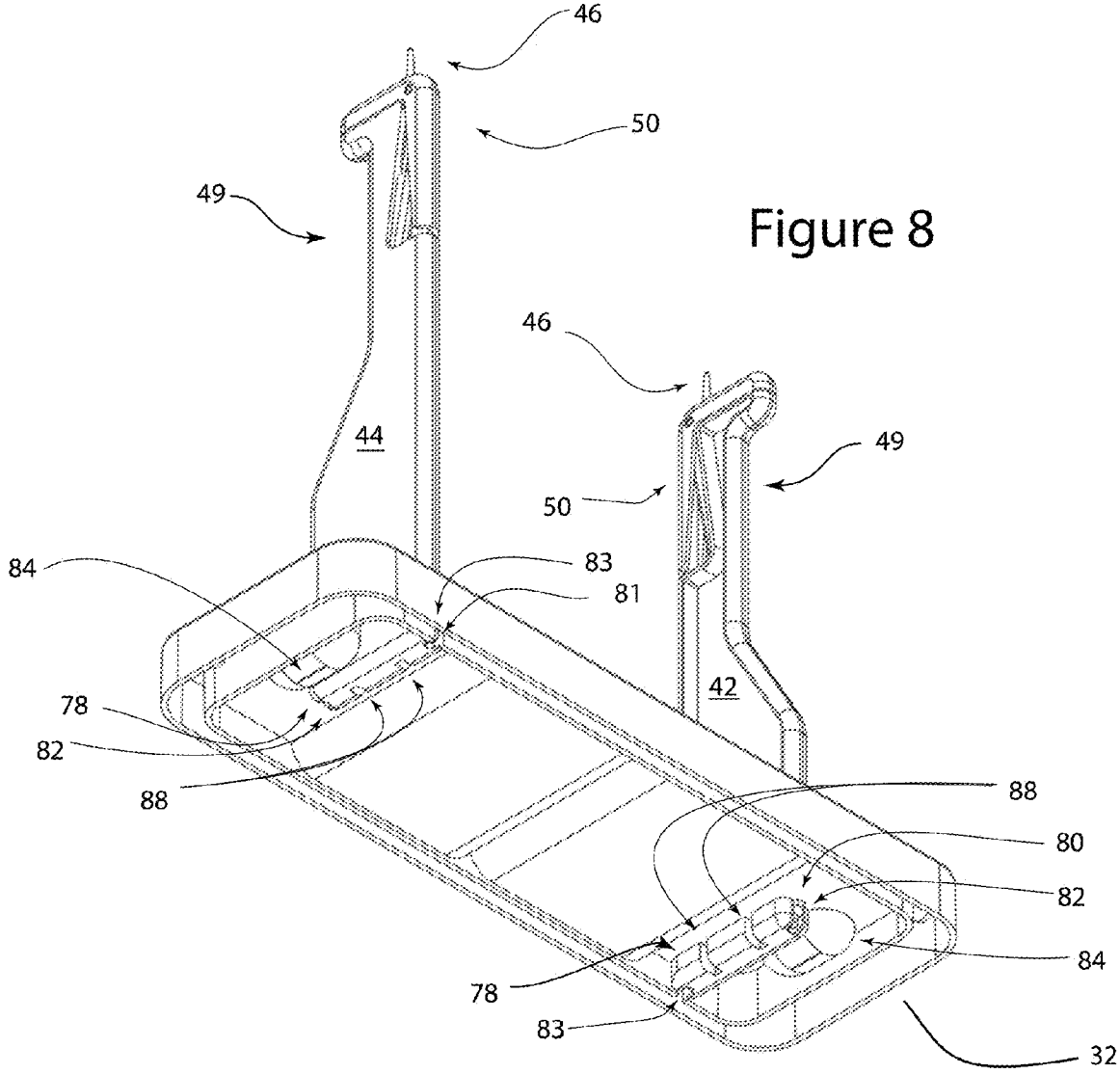
FIG. 8 is an isometric perspective of the support fixture of FIG. 3 viewed from below.

In FIG. 8, the bottom of polymeric base is detailed to more fully explain the configuration of mounting sockets 78 formed therein with ridges 88, slots 82, 83 and pins 80, 81 being visible in relief.

In FIGS. 9-14, pivotable inter-nesting uprights 42 and 44 have been pivoted inwardly and downwardly into major recess 34 forming a generally planar upper surface 68 with lateral surfaces of uprights 42 and 44 being generally coplanar with outer periphery 76 of base 32, with inter-nesting uprights 42 and 44 substantially sealing secondary recesses 36 and 38 in base 32 so that paraphernalia associated with support fixture 30 may be disposed and retained therein when pivotable inter-nesting uprights 42 and 44 have been pivoted inwardly and downwardly, placing support fixture 30 in a conformation suitable for traveling and storage.

Figures 15, 16:
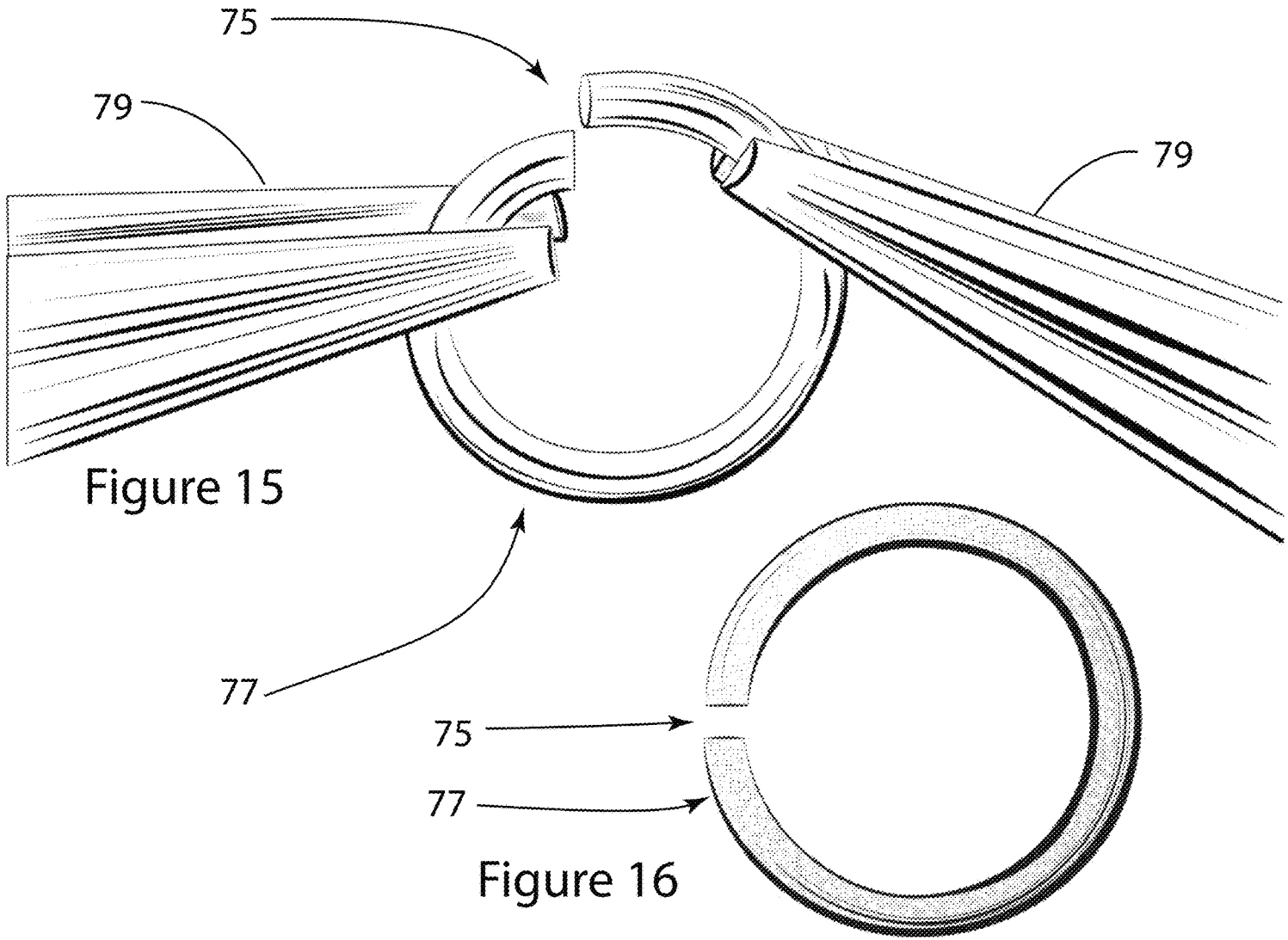
FIG. 15 is a schematic illustrating manipulation of a jump ring using two pair of chain nose pliers.
FIG. 16 is schematic illustration of a jump ring with the gap slightly exaggerated.

In FIG. 15 jump ring 77 is being manipulated using two pair of chain nose pliers 79 while FIG. 16 illustrates jump ring 77 with gap 75 slightly exaggerated.

FIG. 17 illustrates the clamping mechanism of support fixture 30 wherein one of the clamps 60 is illustrated with mouth 58 open as upper jaw 56 has been rotated counter-clockwise by pressing inwardly on vertical leg 53 against spring 55 exposing corrugated pad 66 of resilient silicone rubber on upper surface 62 of lower jaw 63 as well as upper pad 64 of silicone rubber on upper jaw 56. Pins 46 over which links in suitable chains may be draped are also visible in detail in this view. Preferably, pins 46 are integrally formed of polymer molded simultaneously with "L" shaped arms 50 in the same mold cavity as are pins 52. In the preferred embodiment, only 5 polymeric pieces need be molded. These 5 pieces together with metallic springs 55 make for economical manufacture, requiring very little labor to form and assemble and only three mold cavities. Desirably instructions are molded into uprights 42 and 44 informing the user to raise uprights 42 and 44 out of mounting sockets 78 for storage and press them downwardly into sockets 78 for use as shown in FIG. 17.

Figures 9, 10, 11, 12, 13, 14:
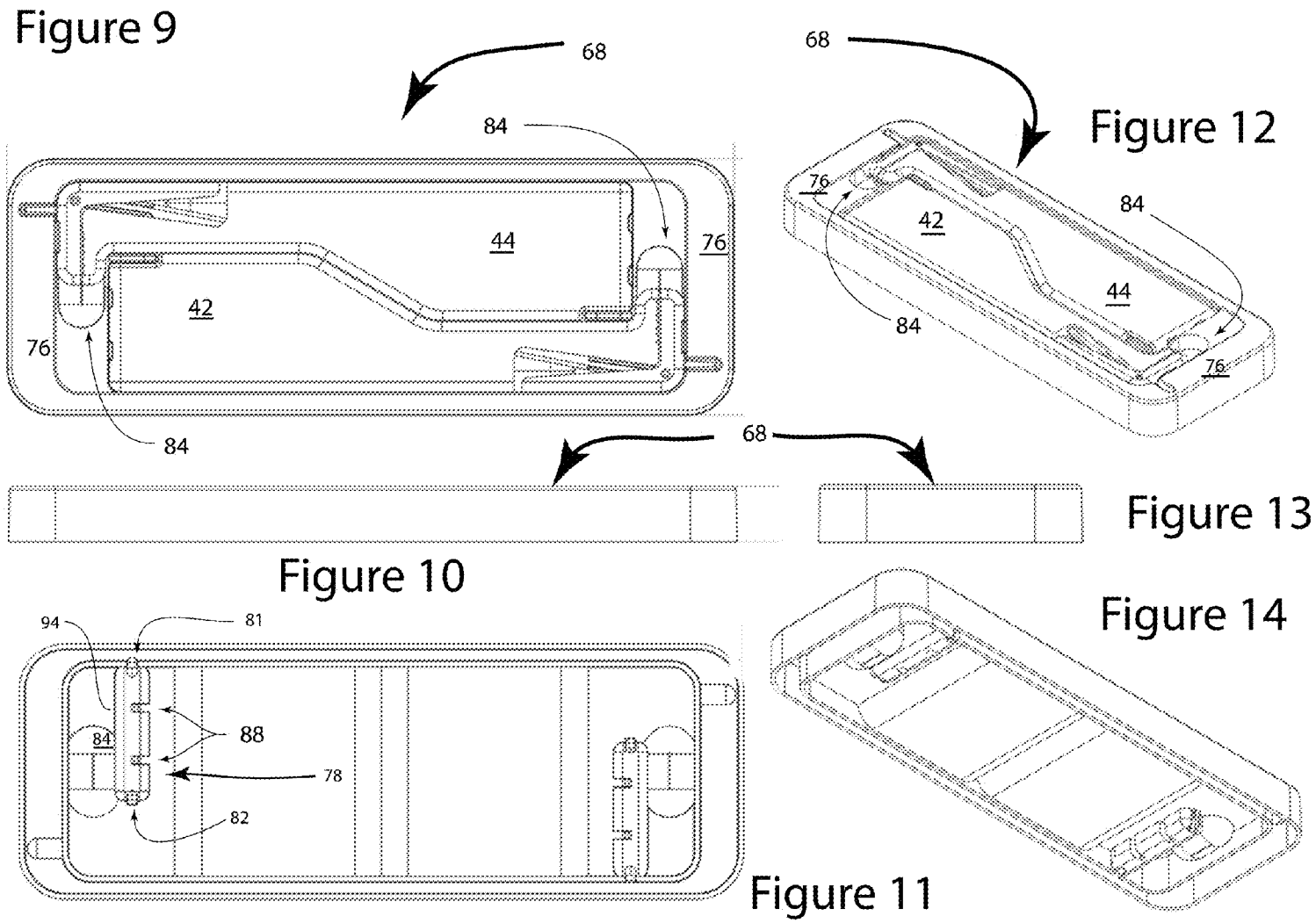
FIG. 9 is a top view of the support fixture of the present invention with both arms folded down into the base for travel and/or storage.
FIG. 10 is front view of the support fixture of FIG. 9.
FIG. 11 is a bottom view of the support fixture of FIG. 9.
FIG. 12 is a top isometric perspective of the support fixture of FIG. 9 with both arms retracted.
FIG. 13 is a side elevation of the support fixture of FIG. 9.
FIG. 14 is a bottom isometric perspective of the support fixture of FIG. 9.

FIGS. 18-21 illustrate the seating mechanism providing bi-stable mounting of upright 42 with the understanding that the mounting of upright 44 is functionally similar. Desirably, transversely extending pins 80 and 81 projecting from lower extremity 72 of each of pivotable uprights 42 and 44 ride in pivot slots 82 and 83 effectively forming a hinge about which pivotable uprights 42 and 44 may be pivoted in the process of converting support fixture 30 from the use configuration as illustrated in FIGS. 1-8 to the storage and travel configuration illustrated in FIGS. 9-14. In FIG. 9, it can be observed that access recess 84 is provided adjacent each of jaws 56 and 63 forming clamp 60 so that the user can easily grasp and pivot each of pivotable uprights 42 and 44 into the use configuration.

Figure 19:
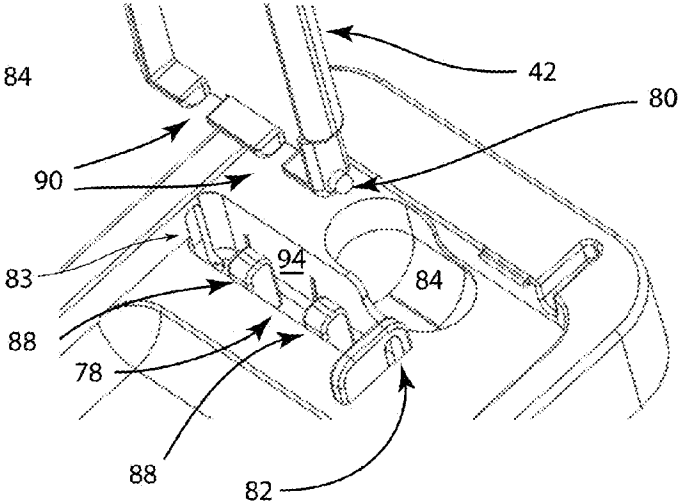
FIGS. 18-25 illustrate details of the mating lower portions of the uprights and the sockets therefor.
Figure 18:
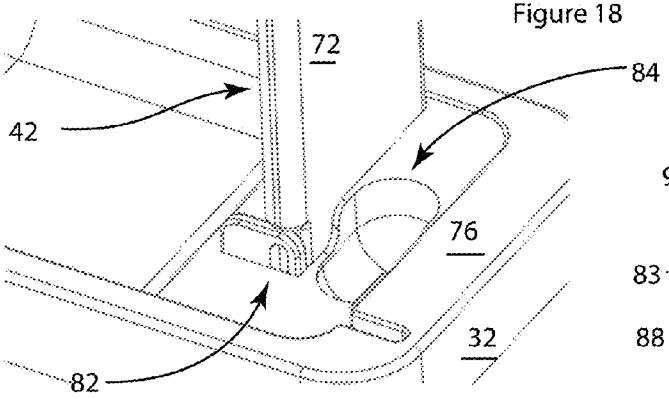
Figure 21:
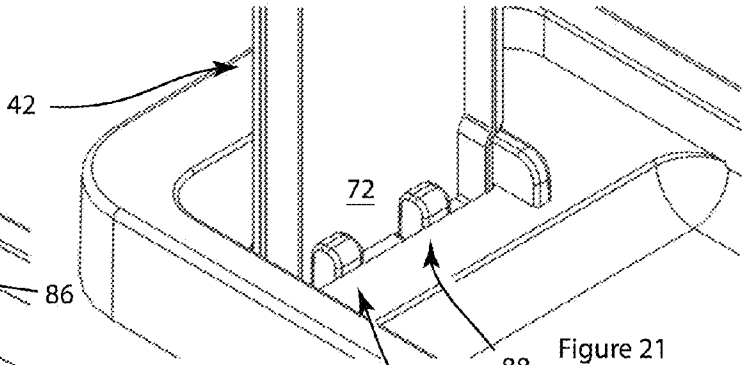
Figure 20:
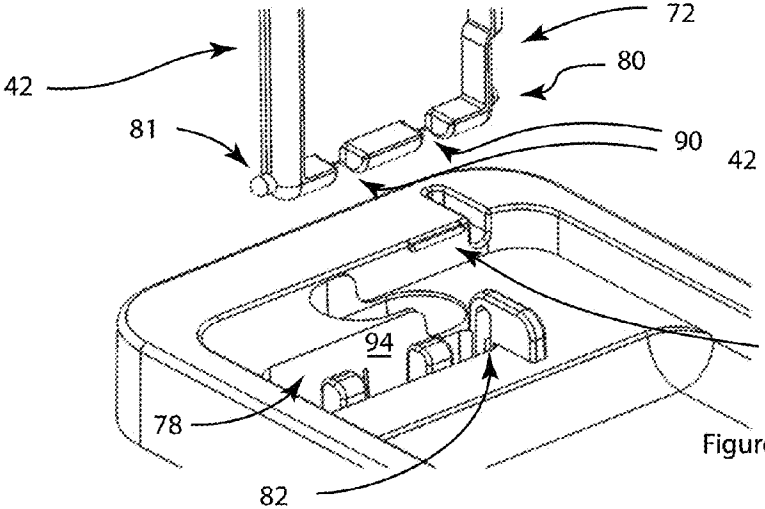
Figure 23:
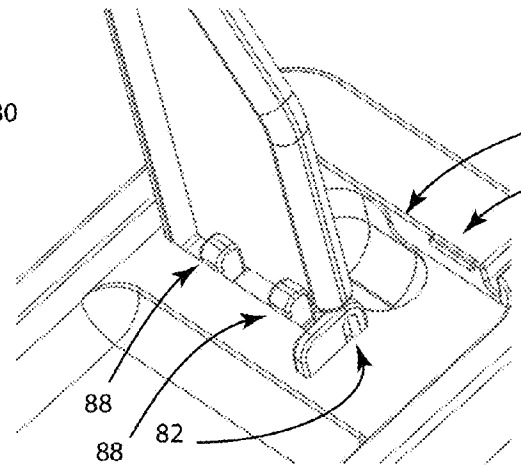
Figure 22:
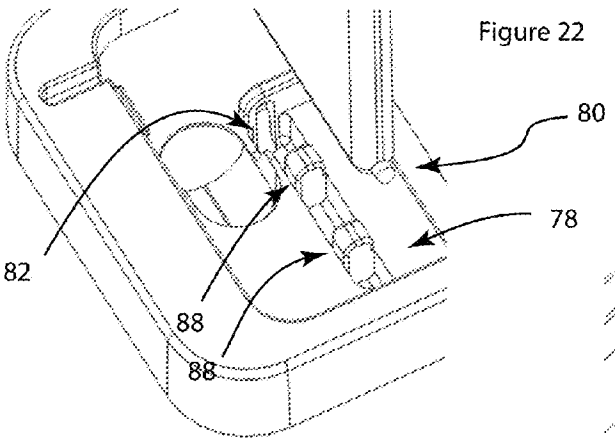
Figure 25:
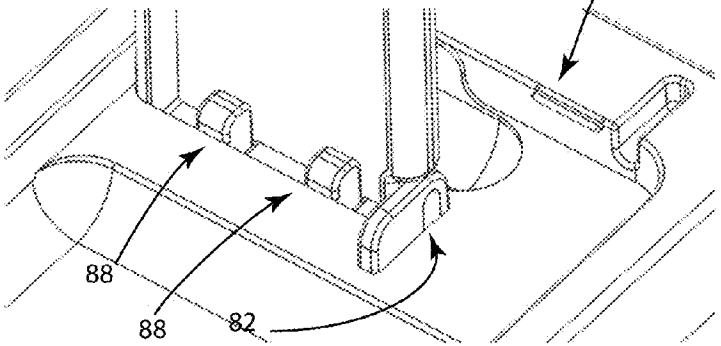
Figure 24:
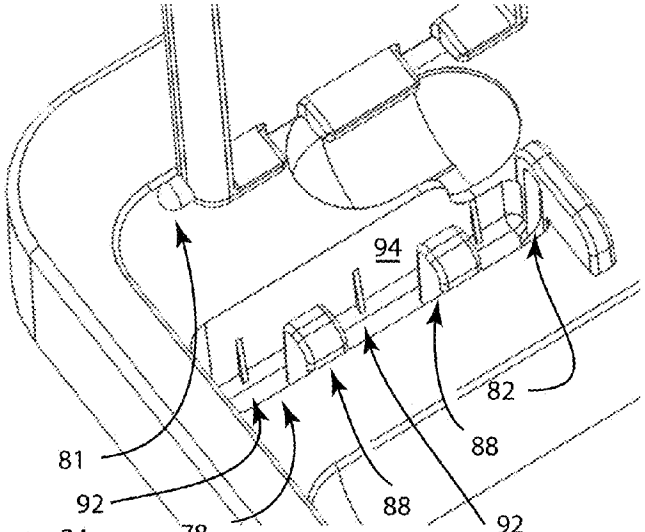
Figure 33:
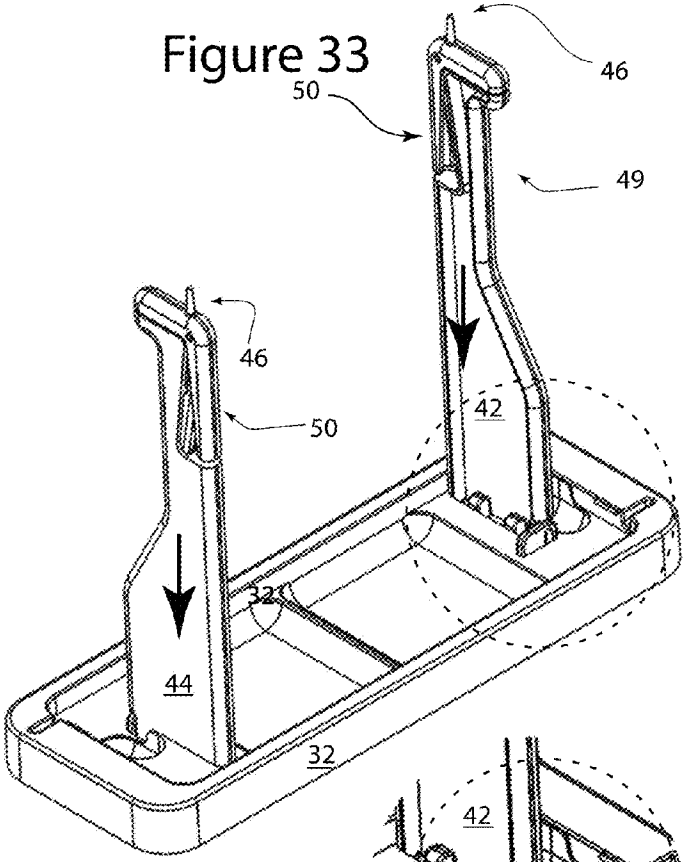
FIGS. 32-35 illustrate seating of the uprights after they have been erected.
Figure 35:
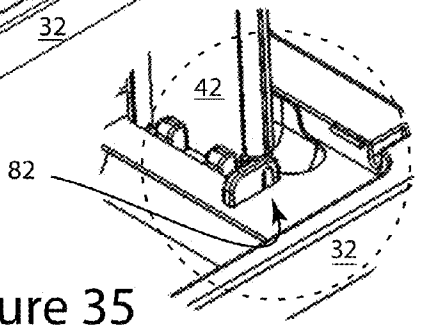
Figure 32:
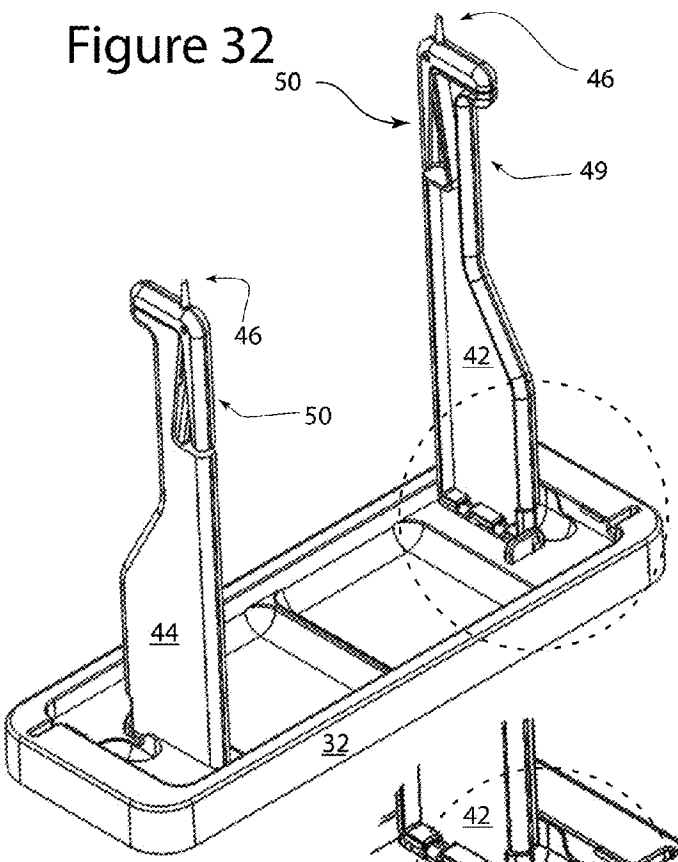
Figure 34:
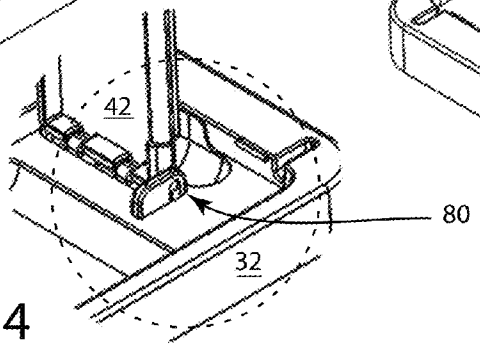

FIGS. 18-25 provide details of how uprights 42 and 44 engage mounting socket 78 formed in base 32 of support fixture 30. Each of lower extremities 72 of each of uprights 42 and 44 have pivot pins 80 and 81 formed therein and adapted to engage pivot slots 82 and 83 formed in the lateral walls of vertically extending mounting sockets 78 (see FIG. 20) with pins 80 and 81 being slidable therein from an upper position to a lower position. In the upper position, uprights 42 and 44 can be retracted into the storage and travel conformation shown in FIGS. 9 through 14 from the use position illustrated in FIGS. 1 through 8 and back again. In FIGS. 18 and 19, it can be observed that the upper extremity of pivot slots 82 and 83 extend above the plane of major recess 34 allowing pivot pins 80 and 81 to also rise above the plane of major recess 34 and accordingly be folded inwardly to form generally planar surfaces 68 illustrated in FIGS. 9 and 12. When uprights 42 and 44 are pivoted upwardly from the storage or travel configuration of FIGS. 9 through 13 as shown in FIGS. 27 through 31, uprights 42 and 44 come to the configurations shown in FIGS. 32 and 34, but are not fixed in position until they are urged downwardly into mounting sockets 78 as shown in FIGS. 33 and 35, whereupon guide ridges 88 in base 32 engage guide slots 90 formed in lower extremity 72 of each of uprights 42 and 44 while clamping wedges 92 (see FIG. 24) force uprights 42 and 44 against retention wall 94 in mounting socket 78 thereby stably supporting uprights 42 and 44 in the use position, making it possible for the user to employ both hands to manipulate pliers 79 and jump ring 77 to mount pendants on chain 48. When it is desired to return support fixture 30 to the storage and travel conformation, uprights 42 and 44 are urged upwardly so that pivot pins 80 and 81 move upwardly in pivot slots 82 and 83, clearing the plane 33 of major recess 34 and allowing uprights 42 and 44 to be urged inwardly and downwardly into major recess 34 in base 32, whereupon retention ledges 86 engage uprights 42 and 44 urging them into the travel and storage conformation. Accordingly, it can be appreciated that uprights 42 and 44 are bistably mounted so that they can be securely fixed into either the usage conformation or the travel and storage conformation.

Figure 26:
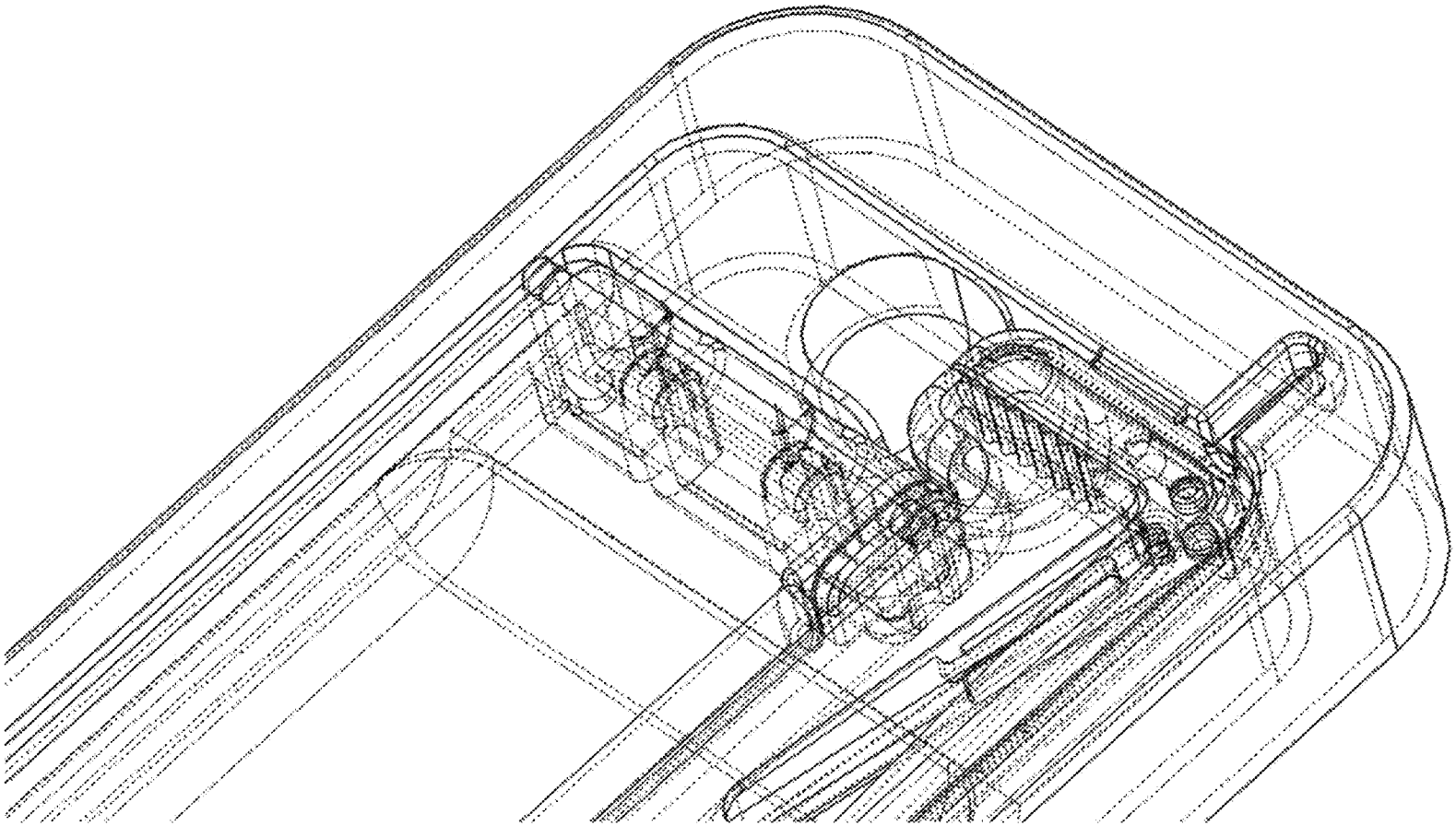
FIG. 26 illustrates hidden details of the sockets and uprights when the support fixture is in the travel or storage conformation.
Figure 27:
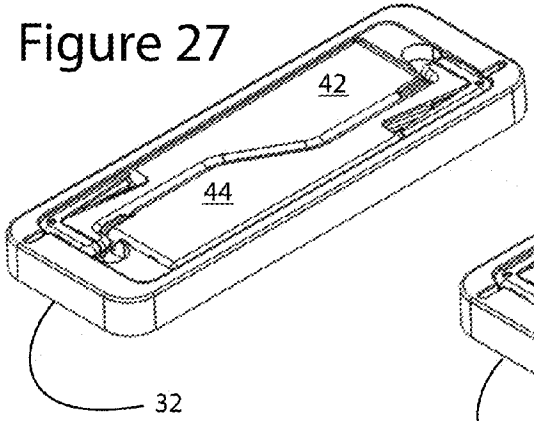
FIGS. 27-31 illustrate how the uprights are erected.
Figure 28:
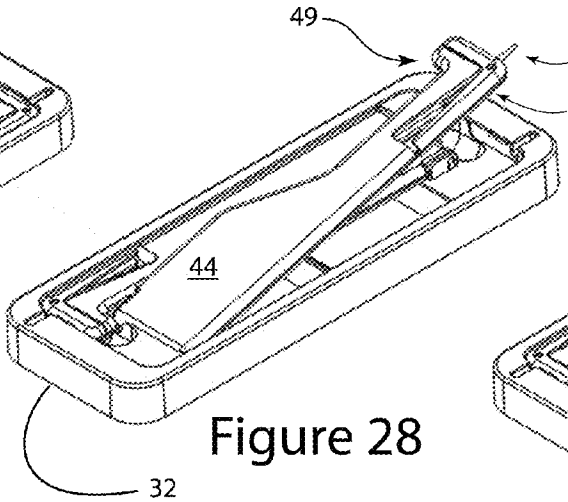
Figure 29:
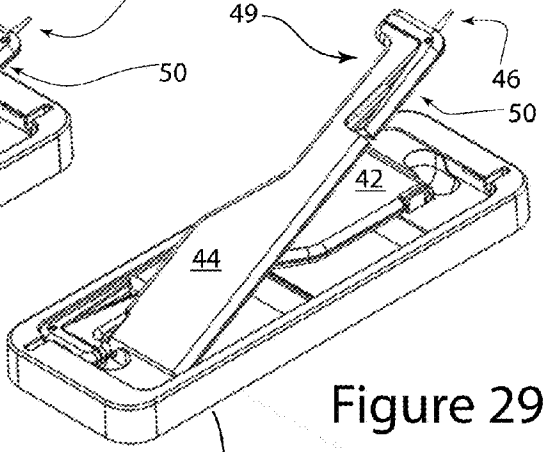
Figure 30:
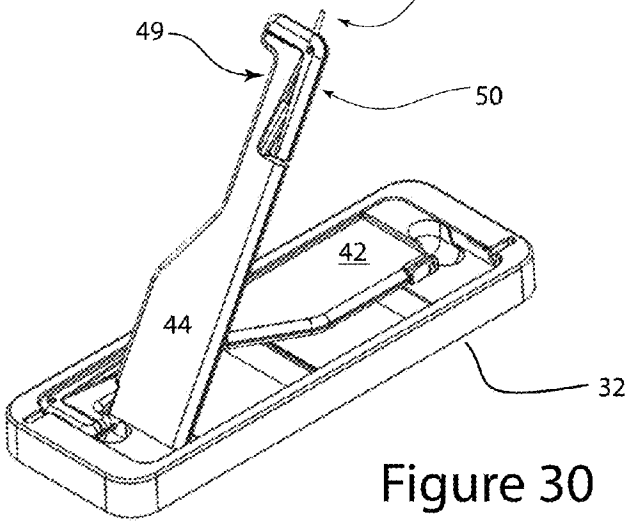
Figure 31:
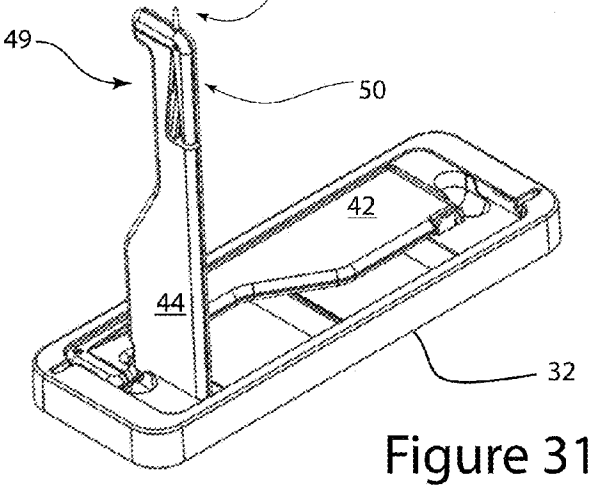

FIG. 26 is a skeleton drawing illustrating hidden features of the mounting of the uprights of the bi-stable support when the uprights are deployed in the nesting configuration. In view of the business of the drawing, it is submitted that reference numbers would only obscure features shown therein but that, in conjunction with the other drawings, FIG. 26 can help with visualization of the mounting features.

While the invention has been described in detail, modifications within the spirit and scope of the invention will be readily apparent to those of skill in the art. In view of the foregoing discussion, relevant knowledge in the art and references discussed above in connection with the Background and Detailed Description, the disclosures of which are all incorporated herein by reference, further description is deemed unnecessary. In addition, it should be understood that aspects of the invention and portions of various embodiments may be combined or interchanged either in whole or in part. Furthermore, those of ordinary skill in the art will appreciate that the foregoing description is by way of example only, and is not intended to limit the invention.

As our invention, we claim:

1. A support fixture for holding a chain extended above a surface to facilitate addition of pendants thereto, said support fixture comprising:

a polymeric base having an upper surface with a generally planar periphery having a major centrally located recess formed therein and having a pair of pivotable inter-nesting uprights pivotably mounted in opposed ends of said major centrally located recess so that said pivotable inter-nesting uprights can be stably disposed in either an upright usage configuration or a nested horizontal configuration substantially filling said major centrally located recess, a retention pin being provided at an upper extremity of each said pivotable inter-nesting upright as well as a clamp having padded jaws urged into engagement by a resilient spring, the upper extremity of each of said pivotable inter-nesting uprights having a "7" shaped portion with an inverted "L"-shaped arm pivotably joined thereto with horizontal portions of the inverted "L" shaped arm and the "7" shaped portion defining the padded jaws of said clamp with said resilient spring being disposed between a vertical leg of the "7" shaped portion and a vertical leg of the inverted "L" shaped arm.

2. The support fixture of claim 1, wherein a lower extremity of each said pivotable inter-nesting upright further comprises two transversely extending pins and the polymeric base further comprises four vertically extending pivot slots and wherein further the transversely extending pins are positioned within the vertically extending pivot slots to form a hinge wherein when said transversely extending pins are located in an upwardly position in said vertically extending pivot slots, said pivotable inter-nesting uprights may be rotated inwardly from said upright usage configuration into said nested horizontal configuration but said pivotable inter-nesting uprights are fixed in said upright usage configuration when said transversely extending pins are urged downwardly in said vertically extending pivot slots.

3. The support fixture of claim 2, wherein the polymeric base further comprises integrally formed therein:

vertically extending guide ridges mounting sockets, each comprising a retention wall, and clamping wedges;

and wherein guide slots are formed in the lower extremity of each said pivotable inter-nesting upright;

and wherein the pivotable inter-nesting uprights are secured in said upright usage configuration upon being urged downwardly into said mounting sockets such that said vertically extending guide ridges engage within said guide slots and said clamping wedges force said pivotable inter-nesting uprights against said retention walls.

4. The support fixture of claim 3, wherein the support fixture is configured such that said pivotable inter-nesting uprights may be pivoted to said nested horizontal configuration by urging said pivotable inter-nesting uprights upwardly, disengaging said vertically extending guide ridges from said guide slots, moving said transversely extending pins upwardly in said vertically extending pivot slots, and rotating said pivotable inter-nesting uprights inwardly into the major centrally located recess.

5. The support fixture of claim 4, wherein the polymeric base further comprises retention ledges formed adjacent the generally planar periphery of said major centrally located recess that engage said pivotable inter-nesting uprights when in a nested conformation, securing said pivotable inter-nesting uprights in said nested horizontal configuration.

6. The support fixture of claim 5, wherein the polymeric base further comprises secondary recesses, separated by a reinforcing divider, below the major centrally located recess.

7. The support fixture of claim 6, wherein the pivotable inter-nesting uprights occupy substantially the entirety of the major centrally located recess when the support fixture is positioned in said nested conformation.

8. The support fixture of claim 7, wherein the polymeric base further comprises an access recess integrally formed thereinto adjacent the padded jaws of the clamp of the upper extremity of each said pivotable inter-nesting upright when the support fixture is positioned in said nested conformation.

9. The support fixture of claim 8, wherein the pivotable inter-nesting uprights are attached to the polymeric base such that when the pivotable inter-nesting uprights pivot inwardly from said upright usage configuration to said nested horizontal configuration, a generally planar upper surface is formed thereby.

10. A support fixture for holding a chain extended above a surface to facilitate addition of pendants thereto, said support fixture comprising:

a polymeric base having a horizontally extending upper surface with a generally planar periphery having a downwardly extending major centrally located recess formed therein and having a pair of substantially identical pivotable inter-nesting uprights pivotably mounted in opposed ends of said downwardly extending major centrally located recess so that said pivotable inter-nesting uprights can be stably disposed in either an upright usage configuration or in a nested horizontal configuration substantially filling said downwardly extending major centrally located recess, a retention pin being provided at an upper extremity of each said pivotable inter-nesting upright and integrally formed therewith as well as a clamp having padded jaws urged into engagement by a resilient spring;

wherein a lower extremity of each said pivotable inter-nesting upright further comprises two transversely extending pins and the polymeric base further comprises four vertically extending pivot slots integrally formed thereinto, wherein the transversely extending pins are positioned within the vertically extending pivot slots to form a hinge, wherein when said transversely extending pins are located in an upwardly position in said vertically extending pivot slots, said pivotable inter-nesting uprights may be rotated inwardly from said upright usage configuration into said nested horizontal configuration but said pivotable inter-nesting uprights are fixed in said upright usage configuration when said transversely extending pins are urged downwardly in said vertically extending pivot slots;

vertically extending guide ridges formed into one of either mounting sockets in said polymeric base or in the lower extremity of each said pivotable inter-nesting upright, and mating guide slots formed into the other of either the lower extremity of each said pivotable inter-nesting upright or said mounting sockets;

wherein the polymeric base further comprises integrally formed therein:

said mounting sockets, each comprising a retention wall, and clamping wedges; and wherein the pivotable inter-nesting uprights are secured in said upright usage configuration upon being urged downwardly into said mounting sockets bringing said vertically extending guide ridges into engagement with said guide slots and wherein said clamping wedges force said pivotable inter-nesting uprights against said retention walls;

wherein the support fixture is configured such that said pivotable inter-nesting uprights may be pivoted to said nested horizontal configuration by urging said pivotable inter-nesting uprights upwardly, disengaging said vertically extending guide ridges from said guide slots, moving said transversely extending pins upwardly in said vertically extending pivot slots, and rotating said pivotable inter-nesting uprights inwardly into the downwardly extending major centrally located recess;

wherein retention ledges are formed in one of the polymeric base adjacent the generally planar periphery of said downwardly extending major centrally located recess or on the pivotable inter-nesting uprights; and engagement recesses are formed into the other of said polymeric base and said pivotable inter-nesting uprights, said retention ledges and said engagement recesses engaging when in a nested conformation, securing said pivotable inter-nesting uprights in said nested horizontal configuration;

wherein the polymeric base further comprises secondary recesses, separated by a reinforcing divider, below the downwardly extending major centrally located recess;

wherein the pivotable inter-nesting uprights occupy substantially the entirety of the downwardly extending major centrally located recess when the support fixture is positioned in said nested conformation;

wherein the polymeric base further comprises an access recess integrally formed thereinto adjacent the padded jaws of the clamp of the upper extremity of each said pivotable inter-nesting upright when the support fixture is positioned in said nested conformation; and wherein the pivotable inter-nesting uprights are attached to the polymeric base such that when the pivotable inter-nesting uprights pivot inwardly from said upright usage configuration to said nested horizontal configuration, a generally planar upper surface is formed thereby.

11. A support fixture for holding a chain extended above a surface to facilitate addition of pendants thereto, said support fixture comprising:

a polymeric base having an upper surface having a downwardly extending major centrally located recess formed therein as well as mounting sockets, each mounting socket comprising a retention wall, a pair of substantially identical pivotable inter-nesting uprights pivotably mountable in said mounting sockets in opposed ends of said downwardly extending major centrally located recess so that said pivotable inter-nesting uprights can be stably disposed in either an upright usage configuration or in a nested horizontal configuration substantially filling said downwardly extending major centrally located recess, a clamp having jaws urged into engagement by a resilient spring;

clamping wedges formed on one of said polymeric base and said pivotable inter-nesting uprights;

wherein a lower extremity of each said pivotable inter-nesting upright and said polymeric base engage through two transversely extending pins and four vertically extending pivot slots, the transversely extending pins being positioned within the vertically extending pivot slots to form a hinge, wherein when said transversely extending pins are located in an upwardly position in said vertically extending pivot slots, said pivotable inter-nesting uprights may be rotated inwardly from said upright usage configuration into said nested horizontal configuration but said pivotable inter-nesting uprights are fixed in said upright usage configuration when said transversely extending pins are urged downwardly in said vertically extending pivot slots.

12. The support fixture for holding a chain of claim 11, wherein the pivotable inter-nesting uprights are secured in said upright usage configuration upon being urged downwardly into said mounting sockets bringing said vertically extending guide ridges into engagement with said guide slots and wherein said clamping wedges force said pivotable inter-nesting uprights against said retention walls.

13. The support fixture for holding a chain of claim 12, wherein the support fixture is configured such that said pivotable inter-nesting uprights may be pivoted from said upright usage configuration to said nested horizontal configuration by urging said pivotable inter-nesting uprights upwardly, disengaging said vertically extending guide ridges from said guide slots, moving said transversely extending pins upwardly in said vertically extending pivot slots, and rotating said pivotable inter-nesting uprights inwardly into the downwardly extending major centrally located recess in said polymeric base.

14. The support fixture for holding a chain of claim 13, wherein retention ledges are formed in one of the polymeric base adjacent the generally planar periphery of said downwardly extending major centrally located recess or on the pivotable inter-nesting uprights; and engagement recesses are formed into the other of said polymeric base and said pivotable inter-nesting uprights, said retention ledges and said engagement recesses engaging when in a nested conformation, securing said pivotable inter-nesting uprights in said nested horizontal configuration, wherein the polymeric base further comprises secondary recesses, separated by a reinforcing divider, below the downwardly extending major centrally located recess, and wherein the pivotable inter-nesting uprights occupy substantially the entirety of the downwardly extending major centrally located recess when the support fixture is positioned in said nested conformation.

15. The support fixture for holding a chain of claim 14, wherein the polymeric base further comprises an access recess integrally formed thereinto adjacent the jaws of the clamp of an upper extremity of each said pivotable inter-nesting upright when the support fixture is positioned in said nested conformation.

16. The support fixture for holding a chain of claim 15, wherein the pivotable inter-nesting uprights are attached to the polymeric base such that when the pivotable inter-nesting uprights pivot inwardly from said upright usage configuration to said nested horizontal configuration, a generally planar upper surface is formed thereby.

* * * * *